US005151715A

United States Patent [19]

Ward et al.

[11] Patent Number: 5,151,715

[45] Date of Patent: Sep. 29, 1992

[54] PRINTHEAD WIPER FOR INK-JET PRINTERS

[75] Inventors: Jefferson P. Ward, Brush Prairie; J. P. Harmon; Kris M. English, both of Vancouver, all of Wash.; Kenneth L. Christensen, Corvallis, Oreg.

[73] Assignee: Hewlett-Packard Company, Palo Alto, Calif.

[21] Appl. No.: 737,629

[22] Filed: Jul. 30, 1991

[51] Int. Cl.[5] ..... B41J 2/165

[52] U.S. Cl. ..... 346/140 R; 15/250.36

[58] Field of Search ..... 346/140 R, 75; 400/701, 400/702; 15/250.36, 250.42, 245; 101/425

[56] References Cited

U.S. PATENT DOCUMENTS

| | | | |
|---|---|---|---|
| 3,089,174 | 5/1963 | Bignon | 15/250.36 |
| 3,892,006 | 7/1975 | Yasumoto | 15/250.22 |
| 3,961,395 | 6/1976 | Journee | 15/250.42 |
| 4,138,759 | 2/1979 | Voorhees | 15/245 |
| 4,296,522 | 10/1981 | Brack | 15/250.36 |
| 4,473,919 | 10/1984 | Fritz, Jr. | 15/250.4 |
| 4,616,060 | 10/1986 | Killgoar, Jr. | 524/574 |
| 4,638,525 | 1/1987 | Sugita et al. | 15/250.36 |
| 4,698,874 | 10/1987 | Fritz, Jr. | 15/250.33 |
| 4,745,653 | 5/1988 | Bliznak | 15/250.04 |
| 4,754,517 | 7/1988 | Aldous | 15/250.04 |
| 4,785,699 | 11/1988 | Oblinger et al. | 83/425 |
| 4,847,940 | 7/1989 | Bradbury | 15/250.40 |
| 4,956,890 | 9/1990 | Journee | 15/250.36 |
| 4,959,673 | 9/1990 | Noda | 346/140 R |

FOREIGN PATENT DOCUMENTS

| | | |
|---|---|---|
| 1228119 | 6/1961 | France . |
| 572184 | 1/1958 | Italy . |
| 101447 | 10/1985 | Japan . |
| 161574 | 1/1986 | Japan . |
| 62-251145 | 10/1987 | Japan . |

*Primary Examiner*—Joseph W. Hartary

[57] ABSTRACT

A printhead wiper for ink-jet printers molded from an elastomer and including a wiping beam having a wiping edge formed at one end of the beam. The other end of the beam is integral with a base. A hole through the beam near the base decreases beam stiffness. A higher durometer elastomer may thus be used without applying excessive wiping force to the printhead. In another embodiment the wiper includes a pair of wiping blades each of which have wiping edges for wiping a printhead traveling thereby. The first wipe removes pooled ink and debris and spreads viscous ink while the second wipe further the spread ink before it can retract to its former drop or pooled configuration.

19 Claims, 6 Drawing Sheets

PRINTHEAD WIPER FOR INK-JET PRINTERS

BACKGROUND OF THE INVENTION

1. Field of the Invention

The present invention relates to ink-jet printers and more particularly to an improved wiper for a printhead on such a printer.

2. Description of the Related Art

An ink-jet printer includes a replaceable printing cartridge having a printhead formed thereon. The cartridge includes a reservoir of ink which is fired through nozzles in the printhead onto a printing medium such as paper. The structure and operation of such printing cartridges is well known to those skilled in the art.

Prior ink-jet printers include a service station at one end of the travel path of a printing carriage upon which the printing cartridge is mounted. The service station includes a wiper for wiping the printhead to remove contaminants, dried ink and the like from the printhead surface containing the nozzle openings. Also provided is a cap which covers the printhead to prevent the ink in the nozzles from drying.

Each time the cartridge travels into or out of the service station, the wiper wipes the printhead. Prior art wipers are molded from an elastomeric material such as ethylene polypropylene diene monomer (EPDM). The wiper is mounted on the printer chassis in the travel path of the cartridge. A pair of wiping edges are on the tip of the wiper on opposite sides thereof. The wiping edges are oriented at a 90° angle relative to the cartridge travel path. One wiping edge is in contact with the printhead surface as it travels into the station thus wiping ink, contaminants, etc. off of the surface. The other wiping edge wipes the surface as the cartridge leaves the station.

Because color ink is more viscous than black ink, effective wiping is harder to achieve on a color cartridge printhead. Although the wiping edge scrapes away particles and pooled ink, viscous ink tends to be spread out by the wiper rather than scraped off. A short time after the viscous ink is spread, it retracts to its former drop or pooled configuration.

Japanese Patent No. 62-251145 deals with this problem by mounting wiper blades on a shaft rotated by a motor. The blades sequentially scrape the printhead surface as the motor rotates the shaft. While this works to clear the printhead, it involves added complexity and expense.

Another problem associated with prior art wipers relates to the rapid rate at which they wear. Wiper wear is proportional to the normal force between the wiper and the printhead surface, all other factors remaining equal. Wiper wear is also proportional to the hardness of the softer of the two surfaces, namely the durometer of the elastomer. Thus, to optimize wiper wear, the hardest elastomer possible should be used with the smallest normal force which is still sufficient to wipe the printhead clean. Increasing the hardness of the elastomer, however, increases the shear forces applied to the printhead and causes undesirable printhead wear.

One possibility for providing a high durometer elastomer wiper with reduced shear forces on the wiped surface in the context of a vehicle windshield wiper is suggested in U.S. Pat. No. 4,638,525 to Sugita et al. The Sugita et al. wiper blade has a cross section which includes a narrowed portion just above the base. When a shear wiping force is applied at the wiping edge opposite the base, the moment of inertia about the base is reduced relative to a blade having a constant cross section. In other words, the wiper tends to bend about the narrowed portion. Because of the reduced stiffness, less shear force is applied to the wiping surface or the same shear force can be applied while using a higher durometer material.

This solution is not suitable for a printhead wiper blade due to the relative dimensions of the blade and to the small scale. Such a wiper may have typical dimensions of 8 mm wide by 7.5 mm tall by 1.25 mm thick. A narrowed portion in the wiper thickness would have to be very carefully and accurately formed to create the appropriate wiper stiffness. Because small changes in the size of the narrowed portion will result in a large change in wiper stiffness, there can be a large variation in wiping force from part to part when the wiper is manufactured in mass quantities.

SUMMARY OF THE INVENTION

In one aspect, the present invention comprises a unitary elastomeric wiper for a printhead formed on a bidirectionally drivable cartridge in an ink-jet printer. The wiper includes a wiping beam having a wiping edge formed at one end thereof. The other end of the wiping beam is mounted on a base. A hole through the beam has an axis oriented substantially 90° to said wiping edge. In another aspect, a bracket cooperates with the base to hold the wiping edge fixed within the travel path of the print cartridge. In still another aspect, the wiper includes a second wiping beam having a wiping edge formed thereon for wiping the printhead cartridge immediately after the wiping edge on the first wiping beam.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
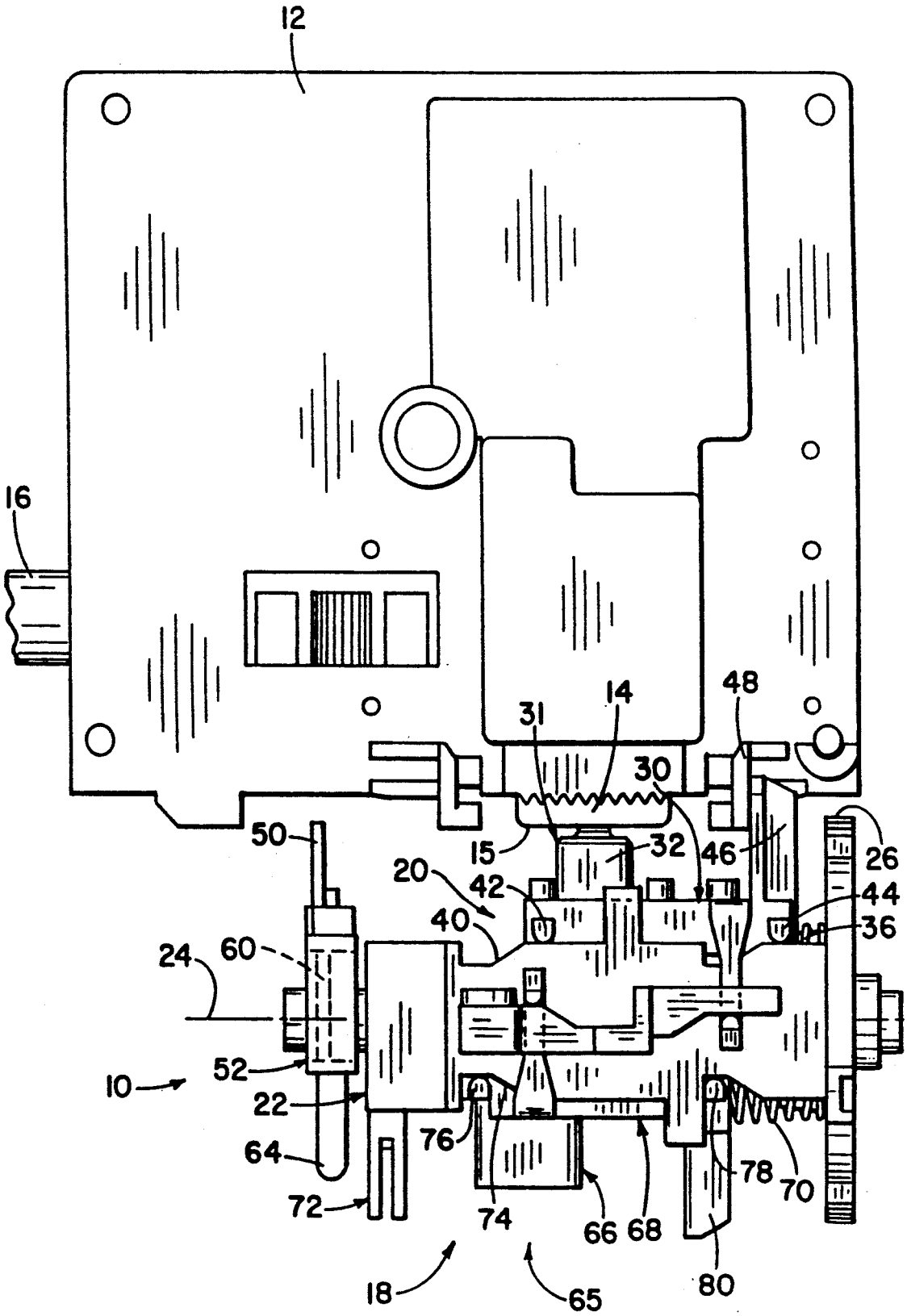
FIG. 1 is a partial front elevational view of an ink-jet printer illustrating an ink-jet printhead and a service station constructed in accordance with the present invention.
Figure 2:
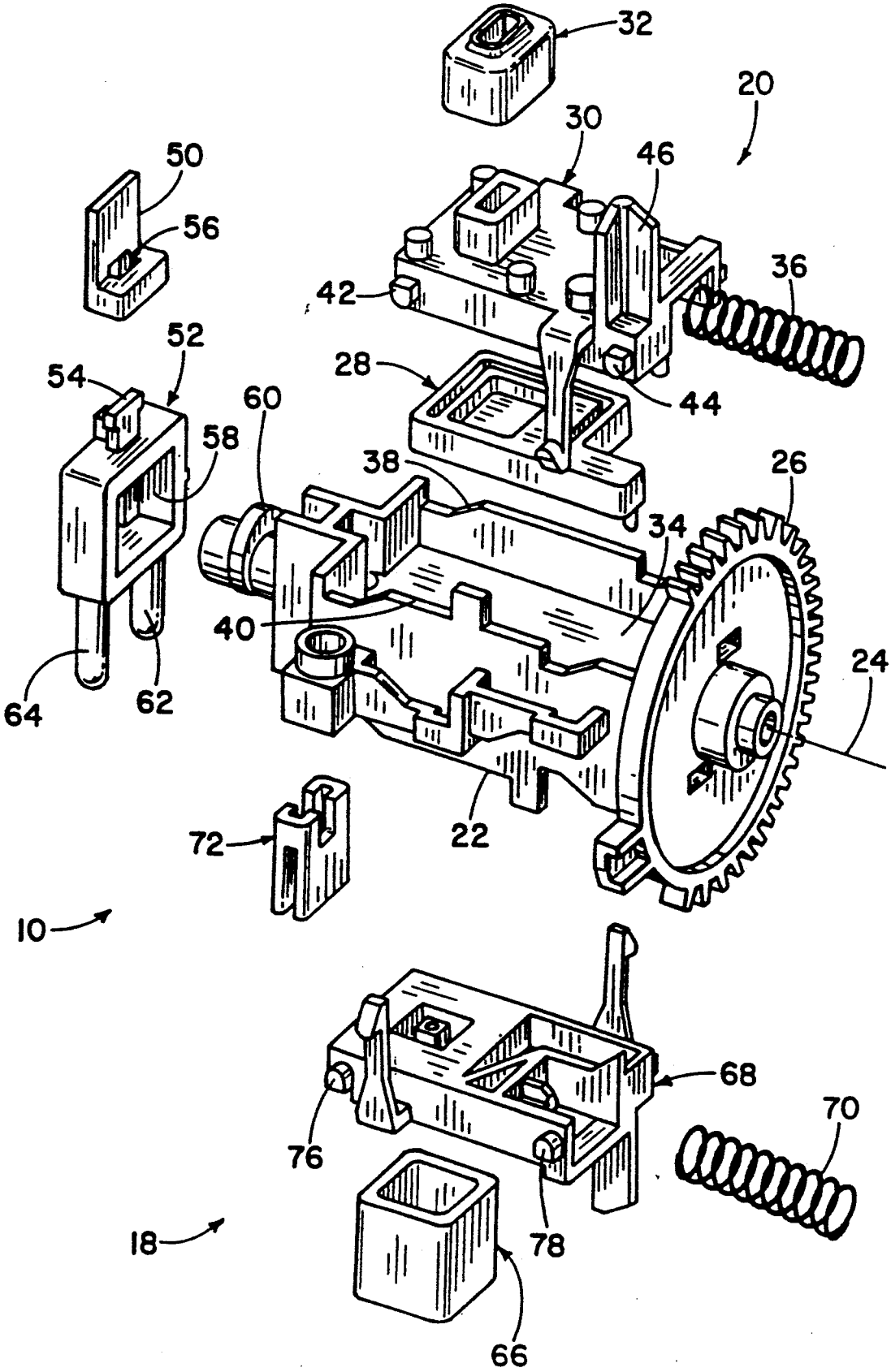
FIG. 2 is an exploded perspective view of both the black cartridge service station and the color cartridge service station of FIG. 1.

Indicated generally at 10 in FIGS. 1 and 2 is a service station for both black cartridge and color cartridge printheads constructed in accordance with the present invention. Service station 10 is incorporated into an ink-jet printer into which either a color cartridge or black cartridge may be loaded for color or black ink printing. The printer includes a carriage 12 which is shown in the view of FIG. 1 having a black cartridge 14 (shown partially broken away) mounted thereon. Cartridge 14 includes a printhead 15 having nozzles (not shown) formed therein for firing ink in the cartridge therefrom. Carriage 12 is bidirectionally moveable along a guide rod 16 which substantially spans the width of the printer. The carriage is shown in its rightmost position, as viewed in FIG. 1, which places cartridge 14 in service station 10. Carriage 12 moves to the service station when the printer is not printing or when the printhead needs servicing. On other printers the service station may be located at the leftmost side of the printer.

Although not shown for clarity, the printer includes structure for guiding paper through the printer so that the paper surface is positioned immediately beneath printhead 15 when carriage 12 moves leftwardly from service station 10.

Service station 10 includes a color cartridge service station, indicated generally at 18, and a black cartridge service station, indicated generally at 20. Service stations 18, 20 are mounted 180° apart on a rotatable carrier 22. Carrier 22 is rotatable 180° about an axis 24. The carrier rotates responsive to a driven gear (not shown) which engages with a sprocket 26 on carrier 22. If a color cartridge, instead of black cartridge 14, is mounted on carriage 12, carrier 22 rotates 180° so that color station 18 is oriented upwardly with black station 20 assuming the position shown for the color station in FIG. 1. On the other hand, with black cartridge 14 mounted on carriage 12, carrier 22 is the position illustrated in FIG. 1.

Black station 20 includes a cap indicated generally at 31. The cap includes a basin structure 28, a black sled 30 and a black sled cover 32 all of which are received in a tray 34 formed in carrier 22. A spring 36 biases sled 30, as well as sled cover 32 and basin structure 28 which are mounted on the sled, to the left as viewed in FIG. 1. Tray 34 includes a pair of opposed cam surfaces, 38, 40 upon which cam followers, like cam followers 42, 44 ride. A post 46 presents a leftward-facing surface which engages with an arm 48 on carriage 12 as the carriage moves to the right. As can be seen in FIG. 1, when carriage 12 moves leftwardly from the service station, spring 36 biases sled 30 to the left. Followers 42, 44 ride surface 40 downwardly thus lowering the sled from the view of FIG. 1. Conversely, as the sled moves toward the service station, arm 48 engages post 46 thus moving sled 30 to the right and upwardly. Such action urges sled cover 32 against printhead 15.

As the black cartridge moves into the station, printhead 15 traverses the tip of a wiper 50 which wipes ink and debris from the printhead surface. Wiper 50 is mounted on a follower bracket 52. The follower bracket includes a post 54 which is received in an opening 56 formed in wiper 50. A rectangular frame 58 surrounds a cam 60 mounted on carrier 22. A pair of downwardly extending posts 62, 64 are received in a pair of corresponding holes (not shown) contained in printer structure (also not shown) beneath carrier 22 in FIG. 1. It can be seen that bracket 52 is maintained in an upper position by cam 60 when carrier 22 is in the position illustrated in FIG. 1. When the carrier rotates 180°, the bracket moves to a lower position as cam 60 rotates from under the bracket.

Color station 18 includes a color cap indicated generally at 65. The color cap includes a sled cover 66 and a color sled 68 (which is also referred to herein as a base). A spring 70 biases the sled to the left in FIG. 1. sled cover 66 is mounted on sled 68. When a color cartridge (not shown), rather than black cartridge 14, is mounted on carriage 12, carrier 22 is rotated 180° about axis 24 thus directing sled cover 66 in an upward direction. When carrier 22 so rotates, cam 60 inverts and drives bracket 52 to its lower position. A color wiper 72 which is mounted on carrier 22 is then also directed upwardly.

A cam surface 74 (in FIG. 1), such being similar to surface 40, is formed on carrier 22. Cam followers 76, 78 ride on the surface similar to the manner in which followers 42, 44 ride on surface 40. An arm 80 extends from color sled 68 in the same fashion that arm 46 extends from black sled 30.

With a color cartridge (not shown) mounted on carriage 12 instead of black cartridge 14, movement of color sled 68 relative to carriage 12 is similar to that previously described for black sled 30. As carriage 12 moves to the right toward the position illustrated in FIG. 1, the color printhead is wiped by wipers 72 the tips of which extend above the tips of wiper 50, which is in its lower position. Next, arm 48 on carriage 12 strikes post 80 thereby moving color sled 68 upwardly and to the right. Sled cover 66 is thus urged against the color printhead.

Figure 3:
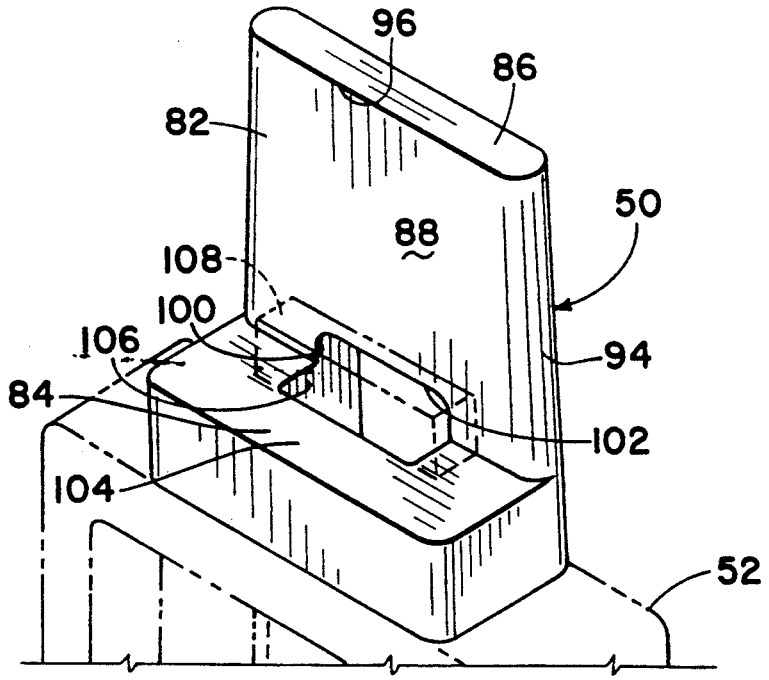
FIG. 3 is an enlarged perspective view of the black wiper and follower bracket (shown in dashed lines) of FIGS. 1 and 2.
Figure 4:
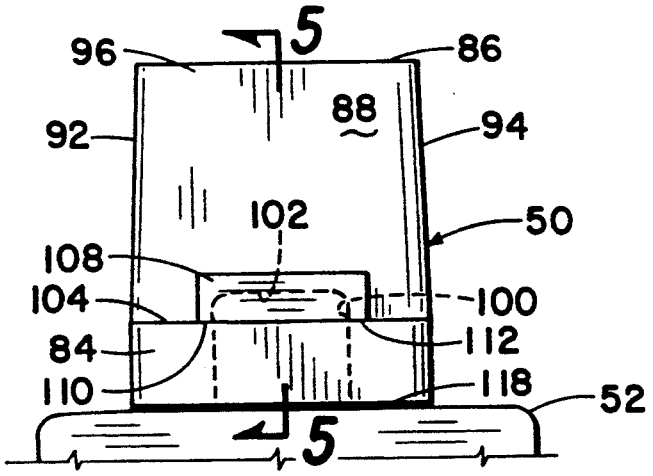
FIG. 4 is a front elevational view of the wiper and bracket of FIG. 3.
Figure 5:
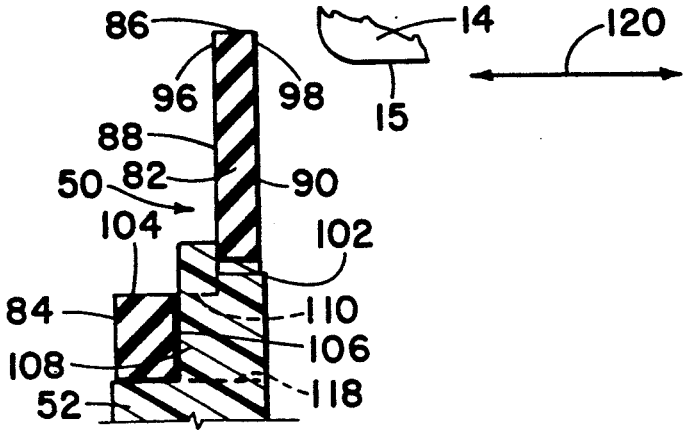
FIG. 5 is a view taken along line 5—5 in FIG. 4.

Attention is now directed to FIGS. 3-5 for a more detailed consideration of the structure of black wiper 50 and the manner in which it is mounted on follower bracket 52. Wiper 50 is integrally formed with a pair of dies. The wiper is made from EPDM having a durometer of 80 Shore A. It should be appreciated that other materials and/or different durometers could be used to implement the present invention. The wiper includes a wiping beam 82 mounted on a base 84. The wiping beam has an upper end 86 and a lower end which is integral with base 84. A pair of opposed planar surfaces 88, 90 extend between end 86 and base 84. Opposed sides 92, 94 also extend between end 86 and the base.

A pair of opposed wiping edges 96, 98 are formed on opposite sides of beam 82 closely adjacent end 86. A beam slot 100, such being also referred to herein as a hole or opening, extends between surfaces 88, 90. The slot includes an upper surface 102. The slot height is defined between an upper surface 104 of base 84 and surface 102. The slot width is defined between the vertical dashed lines illustrating the position of slot 100 in FIG. 4.

Base 84 includes an opening or elongate slot 106. In the present embodiment of the invention, slot 106 extends between the upper and lower surfaces of base 84 and is equal in width to the width of slot 100 in wiping beam 82.

A bracket 108 is integrally formed with follower bracket 52. Bracket 108 includes a pair of downwardly directed surfaces 110, 112 which extend laterally from a central bracket post viewable in FIG. 2.

Bracket 108 includes an upwardly directed surface 118 against which the lower surface of base 84 is flushly abutted. The flexibility of wiper 50 permits it to be stretched to receive the upper portion of bracket 108 through base slot 106 as illustrated in the drawings. When so received, the wiper base is constrained between surfaces 110, 112, acting against upper base surface 104, and surface 118 acting against the lower surface of the base.

In wiper 50, the total wiper height between surface 118 on bracket 52 and end 86 of the wiper is 10 mm. The base height, between surface 118 on the bracket and upper surface 104 of the base is 2.5 mm. The width of beam 82, i.e., the distance between surfaces 88, 90 is 1.2 mm. Beam slot 100 and base slot 106 are each 4 mm wide with the beam slot being 1.5 mm high (as measured between upper beam slot surface 102 and upper base surface 104). The distance between sides 92, 94 at base 84 is 8.8 mm. The radius of the junctures of wiping edges 96, 98 with end 86 is held to no more than 0.05 mm. It should be appreciated that the invention is not limited to wipers having the foregoing particular dimensions but that these are the dimensions of one of the preferred embodiments.

In operation, carrier 22 is positioned on axis 24 as illustrated in FIG. 1. As carriage 12 moves print cartridge 14 across wiper 50 (from right to left as illustrated in FIG. 5), wiping edge 98 strikes cartridge 14 and wipes surface 15 as the print cartridge passes over the wiper. Double-ended arrow 120 illustrates the bidirectional travel path of print cartridge 14. With print cartridge 14 located on the left side of wiper 50, as viewed in FIG. 5, and with the cartridge moving to the right, wiping edge 96 strikes the cartridge and wipes printhead surface 15.

As cartridge 14 moves to the left (in FIG. 5), wiping beam 82 begins to bend to the left. Beam slot 100 reduces the moment of inertia thus resulting in a lower beam stiffness relative to a substantially identical wiper without a beam slot. A higher durometer material, which provides improved wiper wear, can therefore be used without imparting excessive wiping force to printhead 15. In the present embodiment of the invention, wiper 50 has approximately the same deflection as a substantially identical wiper without a beam slot, like beam slot 100, made from 60 durometer Shore A EPDM. Wiper 50, which is made from 80 durometer Shore A EPDM, wears at a rate determined in empirical testing to be approximately 24 times less of the 60 durometer Shore A wiper without the slot.

It is important that the slot not be so large so that the beam deflects or sags under its own weight. Wiping edges 96, 98 must be maintained within the travel path of print cartridge 14 and the beam must be sufficiently stiff to impart a wiping force which cleans printhead surface 15.

Because of its small proportions, a small change in the thickness of wiper 50, i.e., the distance between surfaces 88, 90, results in a large change in its stiffness. The stiffness, however, is much less affected by a change of similar magnitude to the width of the wiper. Thus, small manufacturing variations in the width of beam slot 100 affect wiper stiffness much less than variations of the same magnitude in wiper thickness would. The present invention thus provides smaller variation in wiping force from part to part and therefore, on the average, less wiper wear.

Figure 6:
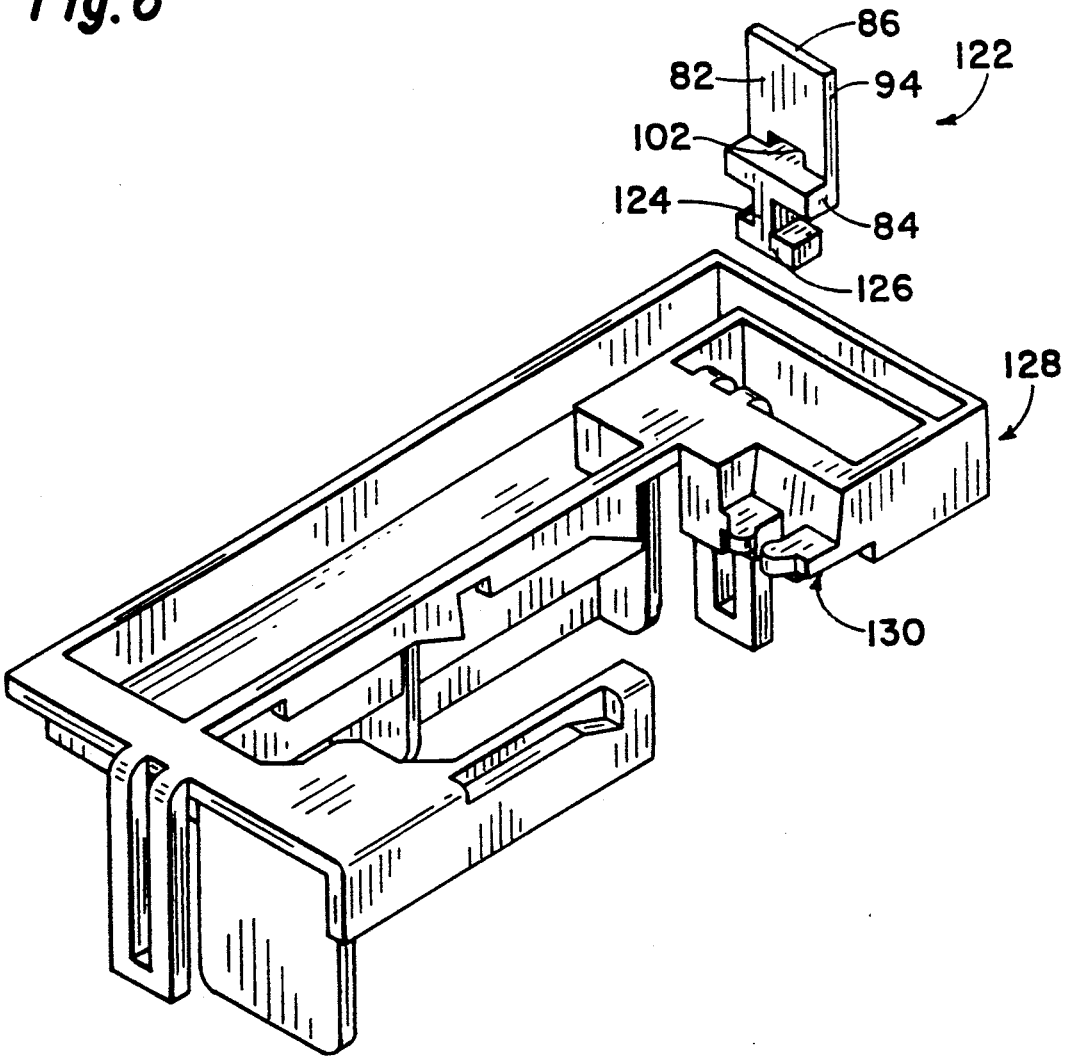
FIG. 6 is an exploded perspective view of a second embodiment of the invention.
Figure 7:
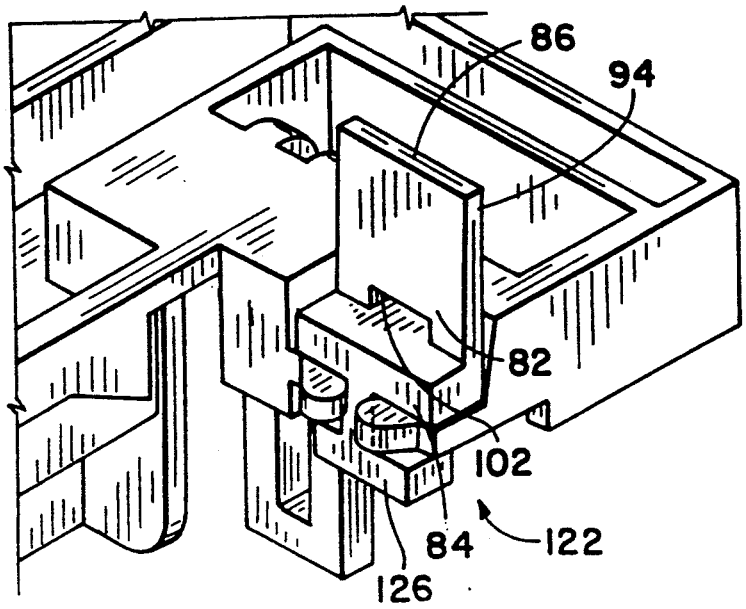
FIG. 7 is an enlarged view of FIG. 6 illustrating the wiper mounted on an associated bracket.
Figure 8:
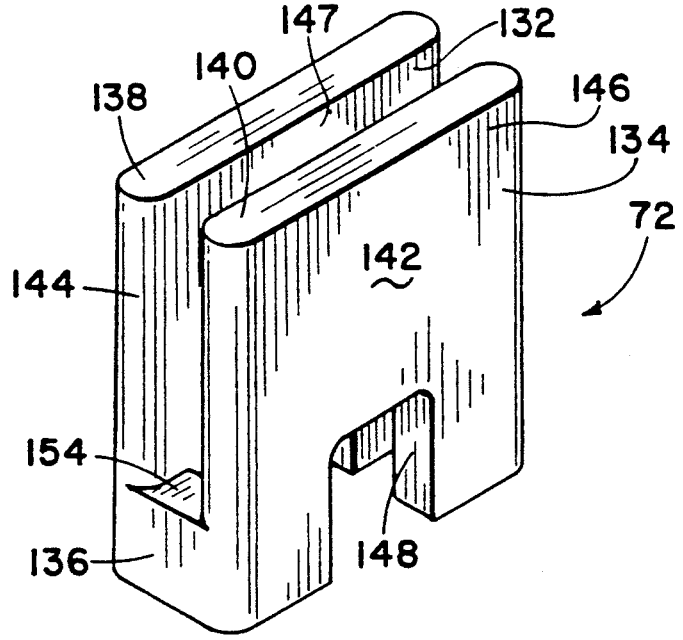
FIG. 8 is an enlarged perspective view of the color wiper of FIGS. 1 and 2.
Figure 9:
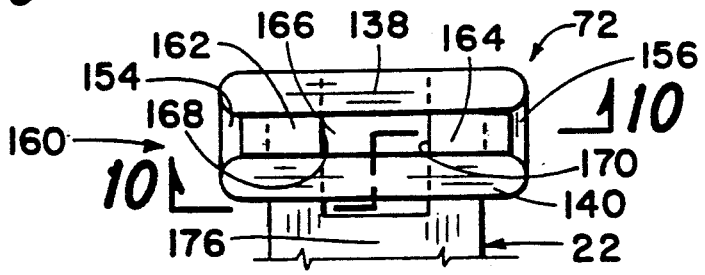
FIG. 9 is a top plan view of the color wiper of FIG. 8 showing the wiper mounted on an associated bracket.
Figure 10:
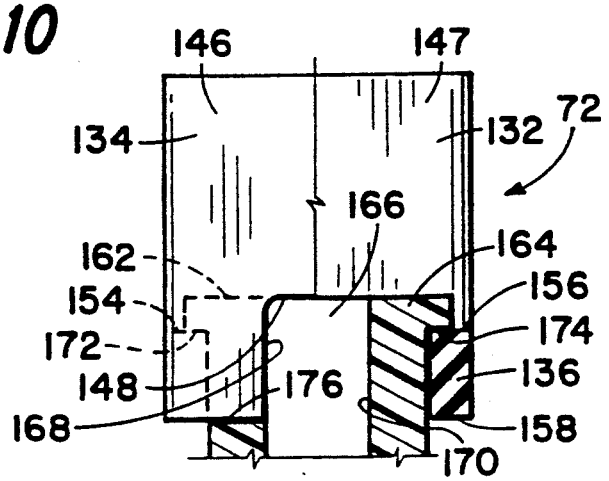
FIG. 10 is a view taken along line 10—10 in FIG. 9.

Turning now to FIGS. 6 and 7, indicated generally at 122 is a second embodiment of a wiper constructed in accordance with the present invention. The structure on wiper 122 which corresponds to that previously described in connection with wiper 50 is identified with the corresponding numeral in FIGS. 6 and 7. Like wiper 50, wiper 122 is molded from EPDM having a durometer of 80 Shore A. The principal difference between wiper 122 and wiper 50 is the manner in which each is mounted on its associated printer. Wiper 122 includes a vertical member 124 which extends downwardly from the lower side of base 84. A horizontal member 126 is formed on the lower end of member 124.

A carrier 128 includes a bracket 130 which cooperates with base 84 and members 124, 126 to securely mount wiper 122 on carrier 128 as illustrated in FIG. 7. As is the case with wiper 50, wiper 122 is sufficiently elastomeric to be deformed to the extent that vertical member 124 can be inserted and removed from bracket 130 without harm to the wiper.

Wiper 122 does not include a base opening or slot as does wiper 150. The mounting structure for wiper 122 permits the wiper to flex substantially uniformally regardless of the direction the print cartridge travel across the end of the wiper.

Attention is now directed to FIGS. 8–11 for a more detailed consideration of the structure of color wiper 72 and the manner in which it is mounted on carrier 22. Like wiper 50, color wiper 72 is integrally formed with a pair of dies. The wiper is made from EPDM having a durometer of 80 Shore A. Wiper 72 includes a pair of wiping beams 132, 134 mounted on a base 136. Each wiping beam 132, 134 has an upper end 138, 140, respectively, and a lower end which is integral with base 136. Each wiping beam includes a pair of opposed planar surfaces, one of which is surface 142 on wiping beam 134, and a pair of opposed sides, one of which is side 144 on wiping beam 132.

Like the wiping beam in wiper 50, each wiping beam 132, 134 includes a pair of opposed wiping edges on planar surfaces, like surface 142, closely adjacent the upper ends 138, 140 of the beams. Wiping edges 146, 147 are visible in the view of FIG. 8.

Figure 11:
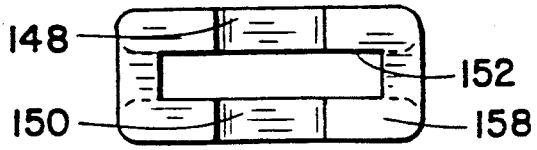
FIG. 11 is a bottom plan view of the color wiper of FIG. 10 shown without the bracket.

Also similar to wiper 50, each beam includes a beam slot, 148, 150, both of which are viewable in FIG. 11. Likewise, wiper 72 includes a base slot 152 which extends from a pair of coplanar upper surfaces 154, 156 (in FIG. 9) of base 136 to a lower surface 158 of the base. Beam slots 148, 150 have a height which extends from upper base surfaces 154, 156 to the uppermost (downwardly-directed) surface of slots 148, 150. A bracket, indicated generally at 160 in FIG. 9 includes a pair of upstanding bracket arms 162, 164. A vertical slot 166 is defined in bracket 160 between inward facing surfaces 168, 170 of arms 162, 164, respectively. Surfaces 168, 170 are coplanar with the upright surfaces of wiper 72 which define the sides of beam slots 148, 150.

Each of arms 162, 164 includes a downwardly-facing surface 172, 174 (in FIG. 10), respectively. Each bracket arm 162, 164 extends upwardly from a bracket surface 176 on carrier 122. Bracket surface 176 is substantially flushly abutted against the underside of base 136. Wiper 72 is thus constrained between downward-facing surfaces 172, 174 on the bracket arms and upwardly-facing surface 176 on carrier 22. As with the previously-described wipers, wiper 72 is sufficiently elastomeric to be stretched for mounting the wiper on and removing it from bracket 160.

The height of wiper 72 as measured from the underside of base 136 to surfaces 138, 140 is 9.85 mm. The base height, the distance between the underside of the base and upper base surfaces 154, 156 is equal to 2.5 mm while the height of beam slots 148, 150 is equal to 1.5 mm. Each beam slot is 3.0 mm wide. The width of each beam is approximately 8.9 mm with each beam having a thickness of approximately 1.2 mm and being separated from each other by a distance of 1.25 mm. The radius of the juncture of each wiping edge, like wiping edge 146 with its associated beam end 140 is, as is the case with wiper 50, limited to no greater than 0.05 mm. As is also the case with wiper 50, the dimensions given here for wiper 72 are those of a preferred embodiment. The invention may also be implemented using other dimensions as well as other wiper shapes.

Figure 13:
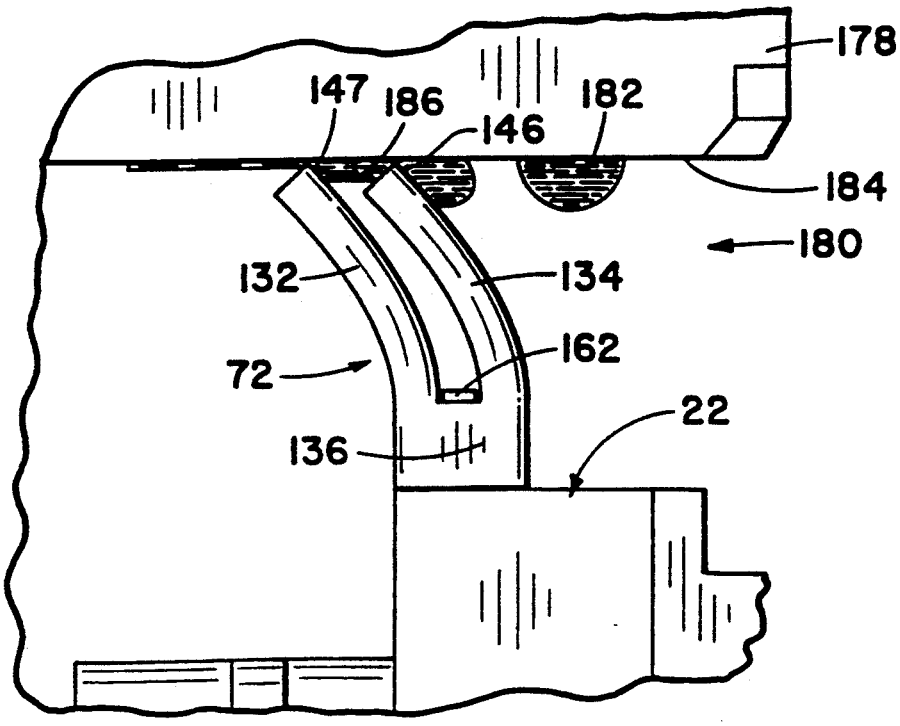
FIG. 13 is the color wiper of FIGS. 8-11 wiping ink from a printhead on a color cartridge.

In operation, a color cartridge 178 (in FIG. 13) is mounted on carriage 12 in FIG. 1 and carrier 22 is rotated 180° about axis 24 to bring wiper 72 to an upper position as illustrated in FIG. 13. Color print cartridge 178 includes a printhead 180 upon which ink drops, like ink drop 182, form. Print cartridge 178 is moving in the direction of arrow 184 responsive to driving of carriage 12 (in FIG. 1). Wiping edge 146 is part way through an ink drop formed on printhead 180 and has scraped away some of the particles and pooled ink. Because the ink on the printhead is somewhat viscous, edge 146 tends to plane over it and spread the ink out into a layer 186 which forms immediately behind wiping edge 146. Ink layer 186 is then wiped from printhead 180 by wiping edge 147 on beam 132 which immediately follows wiping edge 146 as shown in FIG. 13. After wiping edge 147 wipes printhead 180, the ink is substantially removed from the printhead.

Figure 12:
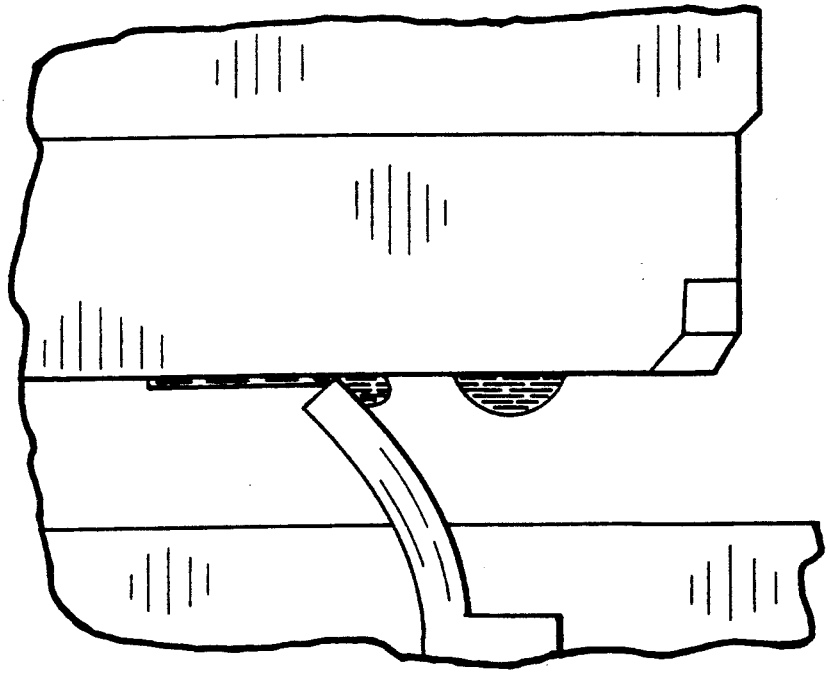
Fig. 12 (PRIOR ART)
FIG. 12 is a somewhat schematic representation of a prior art wiper wiping ink from a printhead on a color cartridge.

With a single-bladed prior art wiper illustrated in FIG. 12, the layer of ink left on the printhead turning the wiping edge of the wiper is sufficiently thick so that ink reforms in drops after the wiping edge passes thereby. This again is due to the tendency of a single wiper, in the prior art and the leading wiper in FIG. 13, to spread the ink, due to its viscous nature, rather than wiping it from the printhead surface. Utilizing the wiper of the invention provides a simple and inexpensive way to improve wiping of ink, especially colored ink which tends to be more viscous, from the printhead. The wiper of the invention reduces pooling of ink on the printhead which in a color print cartridge could result in color mixing.

It should be appreciated that the dual-bladed wiper can be implemented without the beam slot, which decreases beam stiffness, while providing the advantages described above in connection with the operation of wiper 72. Providing the beam openings in the dual-beam wiper, however, also provides the advantages discussed in connection with the description of the structure and operation of the single-beam wipers illustrated in FIGS. 3–5 and in FIGS. 6 and 7, namely use of a higher durometer material to decrease wiper wear while providing appropriate wiping force as a result of increased beam flexibility.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

It is claimed:

1. A unitary wiper for a printhead on a print cartridge in an ink-jet printer, said wiper being made from an elastomeric material and comprising:

a substantially planar beam having a pair of opposed substantially planar surfaces each of which terminates in a wiping edge at a first end of said beam and at a base at a second end of said beam; and a slot formed in said beam, said slot extending into said beam from said second end and from one of said planar surfaces to the other.

2. The wiper of claim 1 wherein said slot is substantially normal to said beam and has a width equal to approximately one half of the length of said wiping edges.

3. The wiper of claim 2 wherein said slot has a height equal to approximately one fourth the width thereof.

4. The wiper of claim 1 wherein said base extends substantially from one surface of said beam to the other and wherein said base is substantially thicker than said beam and includes an opening which extends through said base adjacent said beam slot.

5. The wiper of claim 1 wherein said elastomeric material has a durometer of approximately 80 Shore A.

6. The wiper of claim 1 wherein said wiper further comprises:

a second substantially planar beam having a pair of opposed substantially planar surfaces each of which terminate in a wiping edge at a first end of said beam, said second beam terminating at said base at a second end thereof; and a second slot formed in said second beam, said second slot extending into said second beam from the second end thereof and from one of said second beam planar surfaces to the other.

7. A unitary wiper for a printhead formed on a bidirectionally drivable print carriage in an ink-jet printer, said wiper being made from elastomeric material and comprising;

a base;

a first substantially planar beam having one end which terminates in a pair of opposed wiping edges and another end which terminates at said base;

a second substantially planar beam having one end which terminates in a pair of opposed wiping edges and another end which terminates at said base, said second beam being substantially parallel with said first beam and said wiping edges being substantially coplanar; and means for mounting said base with said wiping edges fixed within a travel path of the print carriage at an angle of substantially 90° to said travel path whereby said wiping edges wipe the printhead each time the print carriage passes thereby.

8. The wiper of claim 7 wherein each of said beams includes an opening extending through said beam and having an axis oriented substantially parallel to said travel path.

9. The wiper of claim 7 wherein said wipers are mounted on said base with a space between said wipers substantially equal to the thickness of one of said wipers.

10. The wiper of claim 9 wherein said mounting means comprises a vertical opening through said base between said beams.

11. The wiper of claim 10 wherein said beam opening and said base opening are adjacent one another.

12. The wiper of claim 11 wherein said base opening comprises an elongate slot oriented substantially parallel to said beams, said base including a substantially planar upper surface with which said slot communicates.

13. A wiping device for a printhead formed on a bidirectionally drivable carriage in an ink-jet printer comprising:

a unitary elastomeric wiper including:

a substantially planar wiping beam having a pair of opposed wiping edges formed at a first end thereof;

a base having a second end of the wiping beam mounted thereon; and a slot through said beam having an axis oriented substantially 90° to said wiping edges and extending into said wiping beam from said second end; and a bracket cooperating with said base to hold said wiping edges fixed within a travel path of the print carriage at an angle of substantially 90° to said travel path whereby said wiping edges wipe the printhead each time the print carriage passes thereby.

14. The wiping device of claim 13 wherein said base includes a slot therein for receiving said bracket therethrough, said base slot and said beam slot being adjacent one another and forming a single contiguous space.

15. The wiping device of claim 14 wherein said base includes a substantially planar upper surface with which said base slot communicates and said bracket includes an upwardly directed surface against which the bottom of said base is abutted and a downwardly directed surface against which said base upper surface is abutted when said bracket is received in said base slot.

16. The wiping device of claim 13 wherein said wiper further includes:

a second substantially wiping beam having a pair of opposed wiping edges formed at a first end thereof, said second wiping beam having a second end thereof mounted on said base and being substantially parallel to said first wiping beam; and a slot through said second beam having an axis oriented substantially 90° to said second-beam wiping edges and extending into said wiping beam from said second end.

17. The wiping device of claim 16 wherein said beam slots have a height equal to approximately the thickness of one of said beams and a length of about one third of the length of said wiping edges.

18. The wiping device of claim 17 wherein said bracket includes a slot adjacent said beam slots for permitting unimpeded beam flexing adjacent said beam slots during wiping.

19. The wiping device of claim 13 wherein said beam slot is sized and shaped to increase beam deflection during printhead wiping and to prevent beam deflection responsive only to the force of gravity.

* * * * *